US006047402A

United States Patent [19]

Chester-Salter

[11] Patent Number: 6,047,402

[45] Date of Patent: Apr. 11, 2000

[54] APPAREL STAIN PROTECTOR

[76] Inventor: Betty J. Chester-Salter, 494 N. Fox Hills Dr. #1, Bloomfield Hills, Mich. 48304

[21] Appl. No.: 09/213,127

[22] Filed: Dec. 17, 1998

[51] Int. Cl.[7] ..... A41D 27/12; A41D 25/00; A42B 5/00

[52] U.S. Cl. ..... 2/46; 2/144; 2/207

[58] Field of Search ..... 2/46, 47, 48, 49.1, 2/49.4, 49.5, 51, 52, 60, 144, 145, 135, 136, 137, 207, 916

[56] References Cited

U.S. PATENT DOCUMENTS

| | | | |
|---|---|---|---|
| D. 287,541 | 1/1987 | Mezer | D2/508 |
| 2,747,192 | 5/1956 | Katz . | |
| 2,763,867 | 9/1956 | Chagnon . | |
| 3,085,247 | 4/1963 | Bixby . | |
| 3,229,875 | 1/1966 | Stoller . | |
| 3,416,157 | 12/1968 | Marder et al. . | |
| 3,618,138 | 11/1971 | Retzkin . | |
| 3,714,669 | 2/1973 | Vorbau . | |
| 3,833,937 | 9/1974 | Taylor | 2/46 |
| 3,914,797 | 10/1975 | Stembridge | 2/48 |
| 4,330,888 | 5/1982 | Klepfer . | |
| 4,453,273 | 6/1984 | Gerrick | 2/46 |
| 4,654,897 | 4/1987 | Rosaen | 2/207 |
| 4,660,226 | 4/1987 | Quilling et al. | 2/49.2 |
| 4,716,595 | 1/1988 | Camphous | 704/216 |
| 4,862,518 | 9/1989 | Williams et al. | 2/49.1 |
| 4,888,827 | 12/1989 | Lee | 2/52 |
| 5,042,087 | 8/1991 | Lewis | 2/52 |

*Primary Examiner*—John J. Calvert
*Assistant Examiner*—Shirra L. Jenkins

[57] ABSTRACT

A apparel stain protector for protecting the front of a user's garment from soiling and staining from spilled food and beverages when eating. The apparel stain protector includes a scarf cover having first and second faces, a pair of end edges, and a pair of side edges extending between the end edges of the scarf cover. The faces of the scarf cover each has a plurality of patches coupled thereto. The patches of the scarf cover each have hook portions of a hook and loop fastener provided thereon for detachable attachment to a fabric material garment of a user to attach the scarf cover to the garment of the user.

13 Claims, 3 Drawing Sheets

APPAREL STAIN PROTECTOR

BACKGROUND OF THE INVENTION

1. Field of the Invention

The present invention relates to apparel stain protectors and more particularly pertains to a new apparel stain protector for protecting the front of a user's garment from soiling and staining from spilled food and beverages when eating.

2. Description of the Prior Art

The use of apparel stain protectors is known in the prior art. More specifically, apparel stain protectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,914,797 by Stembridge; U.S. Pat. No. 3,416,157 by Marder et al.; U.S. Pat. No. 4,862,518 by Williams et al; U.S. Pat. No. 4,716,595 by Camphous; U.S. Pat. No. 3,085,247 by Bixby; and U.S. Pat. No. Des. 287,541 by Mezer.

While these devices fulfill their respective, particular objectives and requirements, the aforementioned patents do not disclose a new apparel stain protector. The inventive device includes a scarf cover having first and second faces, a pair of end edges, and a pair of side edges extending between the end edges of the scarf cover. The faces of the scarf cover each has a plurality of patches coupled thereto. The patches of the scarf cover each have hook portions of a hook and loop fastener provided thereon for detachable attachment to a fabric material garment of a user to attach the scarf cover to the garment of the user.

In these respects, the apparel stain protector according to the present invention substantially departs from the conventional concepts and designs of the prior art, and in so doing provides an apparatus primarily developed for the purpose of protecting the front of a user's garment from soiling and staining from spilled food and beverages when eating.

SUMMARY OF THE INVENTION

In view of the foregoing disadvantages inherent in the known types of apparel stain protectors now present in the prior art, the present invention provides a new apparel stain protector construction wherein the same can be utilized for protecting the front of a user's garment from soiling and staining from spilled food and beverages when eating.

The general purpose of the present invention, which will be described subsequently in greater detail, is to provide a new apparel stain protector apparatus and method which has many of the advantages of the apparel stain protectors mentioned heretofore and many novel features that result in a new apparel stain protector which is not anticipated, rendered obvious, suggested, or even implied by any of the prior art apparel stain protectors, either alone or in any combination thereof.

To attain this, the present invention generally comprises a scarf cover having first and second faces, a pair of end edges, and a pair of side edges extending between the end edges of the scarf cover. The faces of the scarf cover each has a plurality of patches coupled thereto. The patches of the scarf cover each have hook portions of a hook and loop fastener provided thereon for detachable attachment to a fabric material garment of a user to attach the scarf cover to the garment of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new apparel stain protector apparatus and method which has many of the advantages of the apparel stain protectors mentioned heretofore and many novel features that result in a new apparel stain protector which is not anticipated, rendered obvious, suggested, or even implied by any of the prior art apparel stain protectors, either alone or in any combination thereof.

It is another object of the present invention to provide a new apparel stain protector which may be easily and efficiently manufactured and marketed.

It is a further object of the present invention to provide a new apparel stain protector which is of a durable and reliable construction.

An even further object of the present invention is to provide a new apparel stain protector which is susceptible of a low cost of manufacture with regard to both materials and labor, and which accordingly is then susceptible of low prices of sale to the consuming public, thereby making such apparel stain protector economically available to the buying public.

Still yet another object of the present invention is to provide a new apparel stain protector which provides in the apparatuses and methods of the prior art some of the advantages thereof, while simultaneously overcoming some of the disadvantages normally associated therewith.

Still another object of the present invention is to provide a new apparel stain protector for protecting the front of a user's garment from soiling and staining from spilled food and beverages when eating.

Yet another object of the present invention is to provide a new apparel stain protector which includes a scarf cover having first and second faces, a pair of end edges, and a pair of side edges extending between the end edges of the scarf cover. The faces of the scarf cover each has a plurality of patches coupled thereto. The patches of the scarf cover each have hook portions of a hook and loop fastener provided thereon for detachable attachment to a fabric material garment of a user to attach the scarf cover to the garment of the user.

Still yet another object of the present invention is to provide a new apparel stain protector that comes in a tie configuration for men and a scarf configuration for women.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
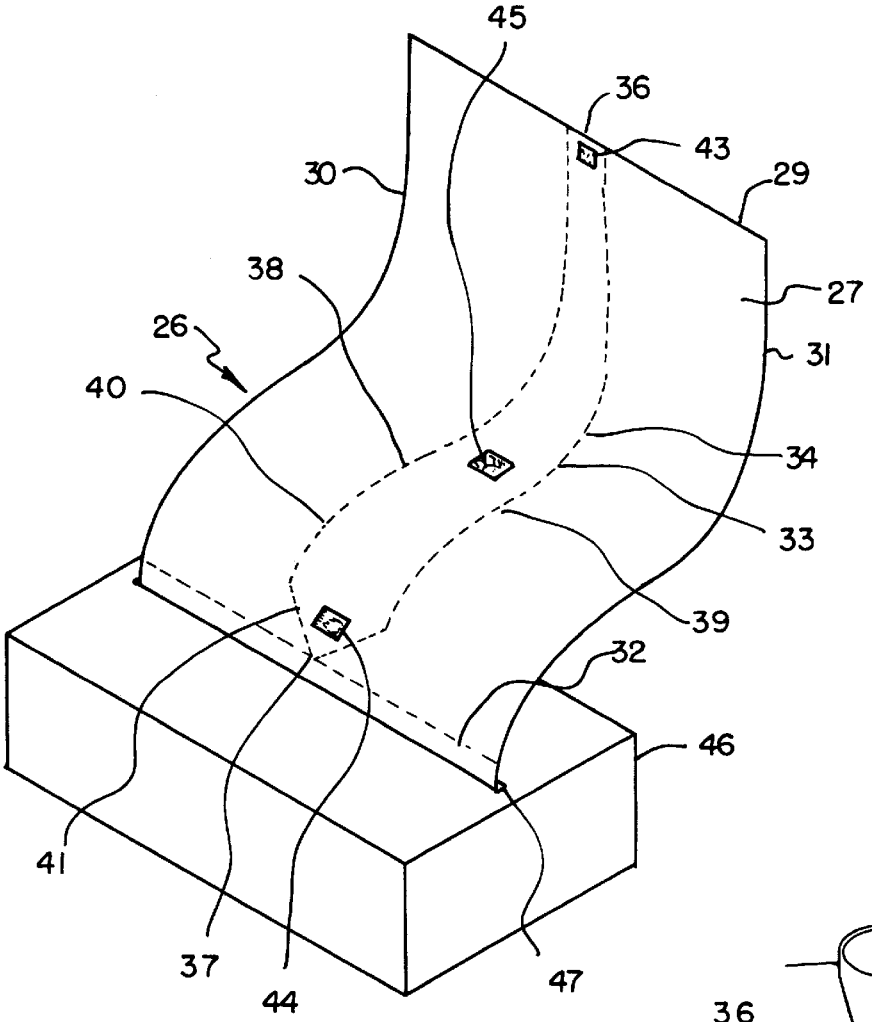
FIG. 1 is a schematic perspective view of the sheet of the tie cover embodiment of the present invention.

With reference now to the drawings, and in particular to FIGS. 1 through 6 thereof, a new apparel stain protector embodying the principles and concepts of the present invention will be described.

As best illustrated in FIGS. 1 through 6, one embodiment of the apparel stain protector generally comprises a scarf cover having first and second faces, a pair of end edges, and a pair of side edges extending between the end edges of the scarf cover. The faces of the scarf cover each has a plurality of patches coupled thereto. The patches of the scarf cover each have hook portions of a hook and loop fastener provided thereon for detachable attachment to a fabric material garment of a user to attach the scarf cover to the garment of the user.

With reference to FIGS. 3, 4, 5, and 6, the first embodiment of the apparel stain protector comprises a scarf cover 10 having first and second faces 11,12, a pair of end edges 13,14, and a pair of side edges 15,16 extending between the end edges of the scarf cover. The scarf cover has a length defined between the end edges of the scarf cover and a width defined between the side edges of the scarf cover.

The side edges of the scarf cover each have first and second end regions 17,18 and a middle region 19 interposed between the end regions of the respective side edge of the scarf cover. The first end regions of the side edges of the scarf cover are positioned adjacent a first of the end edges of the scarf cover and have about equal lengths to one another. The first end regions of the side edges of the scarf cover preferably converge towards each other in a direction towards the first end edge of the scarf cover. The second end regions of the side edges of the scarf cover are positioned adjacent a second of the end edges of the scarf cover and have about equal lengths to one another. Preferably, the second end regions of the side edges of the scarf cover converge towards each other in a direction towards the second end edge of the scarf cover. The middle regions of the side edges of the scarf cover are extended substantially parallel to one another and have about equal lengths to one another.

In an ideal illustrative embodiment, the length of the scarf cover is between about 42 inches to about 56 inches and the width of the scarf cover across the middle regions of the side edges of the scarf cover is between about 8 inches to about 12 inches. Ideally, the width of the scarf cover at each of end edges of the side edges of the scarf cover is between about 8 inches to about 10 inches. The length of each end region of the side edges of the scarf cover is ideally about 5 inches.

The scarf cover comprises a flexible paper material and preferably further comprises a fire-retardant composition applied to the flexible paper material of the scarf cover.

Figure 4:
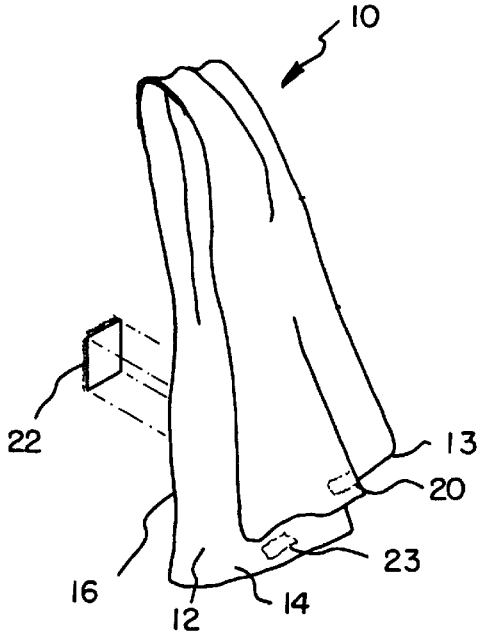
FIG. 4 is a schematic exploded perspective view of the scarf over embodiment of the present invention.
Figure 5:
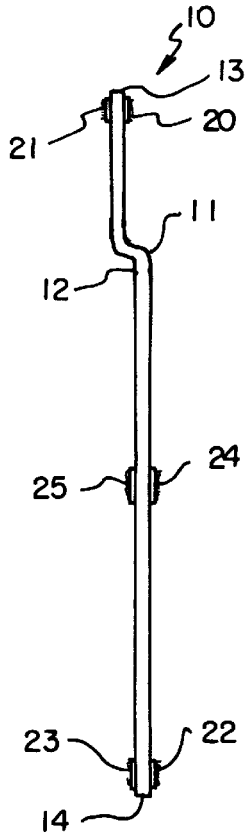
FIG. 5 is a schematic side view of the present invention.
Figure 6:
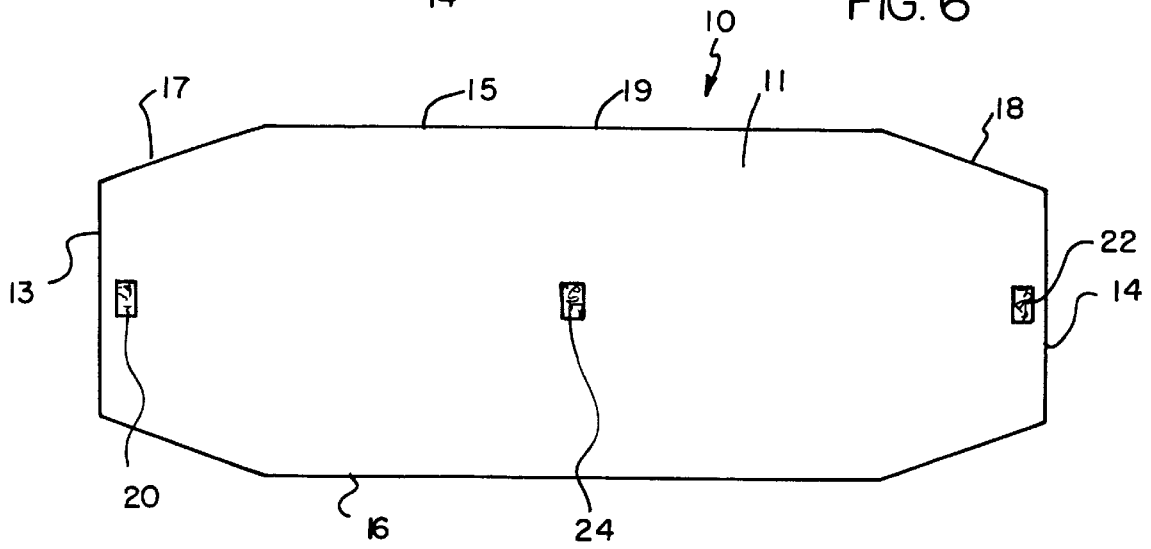
FIG. 6 is a schematic plan view of the present invention.

The faces of the scarf cover each have a plurality of generally rectangular patches 20,21,22,23,24,25 coupled thereto. The patches of each face of the scarf cover each are ideally equidistantly positioned between the side edges of the scarf cover. As best illustrated in FIG. 4, the patches of the scarf cover each have hook portions of a hook and loop fastener provided thereon. In use, the hooks portions is designed for detachable attachment to a fabric material garment of a user to attach the scarf cover to the garment of the user. Each of the faces of the scarf cover has a first of the respective patches 20,21 positioned adjacent a first of the end edges of the scarf cover. Each of the faces of the scarf cover has a second of the respective patches 22,23 positioned adjacent a second of the end edges of the scarf cover. Optionally, each of the faces of the scarf cover may have a third of the respective patches 24,25 positioned on the respective face of the scarf cover about equidistantly spaced between the end edges of the scarf cover.

In use, the scarf cover may be draped over the front of a user's garment to protect the front of the user's garment from soiling from spilled food and beverages. The scarf cover may also be wrapped around the neck of the user in a similar fashion as a traditional scarf. The scarf cover may further be looped through a collar of the user. The first and second faces of the scarf cover preferably have designs and patterns thereon to provide decoration to the scarf cover so that scarf cover may be used as an apparel accessory by the user. The patches are designed for detachably attaching to the garment of the user to cover the garment to protect the garment from food and beverage spills.

Figure 2:
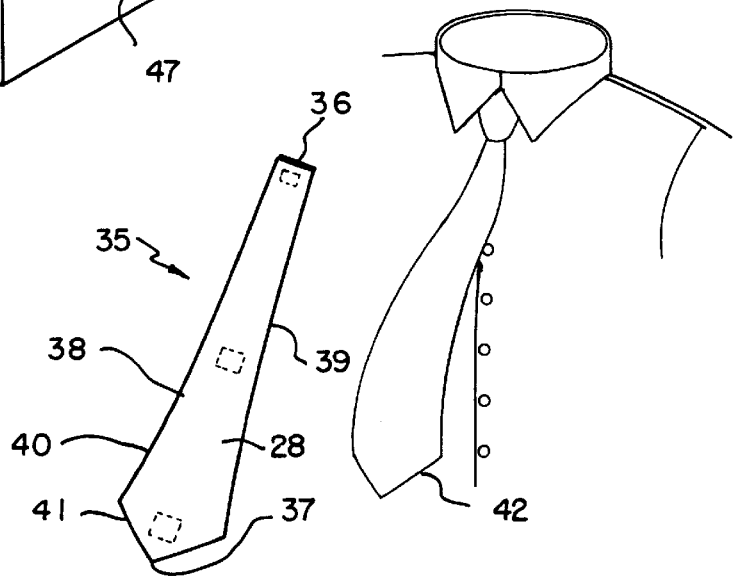
FIG. 2 is another schematic perspective view of the tie cover embodiment of the present invention in use.
Figure 3:
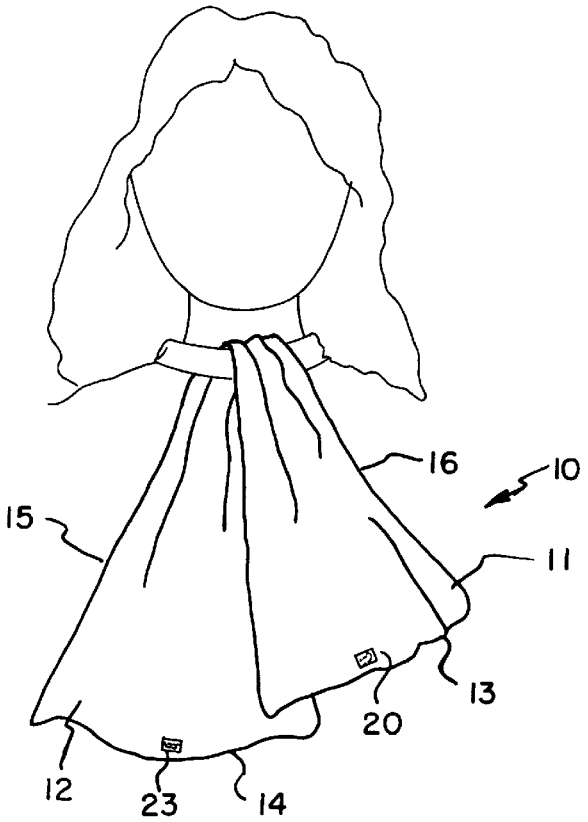
FIG. 3 is a schematic perspective view of the scarf cover embodiment of the present invention.

FIGS. 1 and 2 illustrate a second embodiment of the invention comprising a generally rectangular sheet 26 having first and second faces 27,28, a pair of end edges 29 and a pair of side edges 30,31 extending between the end edges of the sheet. The end edges of the sheet are extended substantially parallel to one another. The side edges of the sheet are extended substantially parallel to one another and substantially perpendicular to the end edges of the sheet.

The sheet has a plurality of spaced apart and substantially parallel lateral separation lines 32 extending between the side edges of the sheet. The lateral separation lines of the sheet divide the sheet into a plurality of generally rectangular panels. The lateral separation lines of the sheet are preferably spaced apart at generally equal intervals between the end edges of the sheet. The sheet is separable along each of the lateral separation lines of the sheet. Preferably, the sheet has a plurality of perforations along each of the lateral separation lines of the sheet for aiding separation of the sheet along the lateral separation lines of the sheet.

Each of the panels has a pair of ends extending substantially parallel to the end edges of the sheet and a pair of sides defined along the side edges of the sheet. Each of the panels of the sheet has a tie cover region 33 therein. The tie cover region of each of the panels has an outer boundary 34 extending between the ends of the respective panel. Each tie cover region is preferably substantially centered between the sides of the respective panel.

In use, each tie cover region is separable from the associated panel along the outer boundary of the respective tie cover region. As illustrated in FIG. 2, each tie cover region forms a tie cover 35 when separated from the associated panel. Each panel has a plurality of perforations along the outer boundary of the associated tie cover region for aiding separation of the associated tie cover region from the remainder of the respective panel.

The outer boundary of each tie cover region has an upper end 36, a lower tip 37 and a pair of sides 38,39. Each of the sides of each tie cover region has generally straight upper and lower portions 40,41. The upper portions of the sides of each tie cover region are positioned adjacent the upper end of the respective tie cover region. The upper portions of the sides of each tie cover region converge towards one another towards the upper end of the respective tie cover region. The lower portions of the sides of each tie cover region are positioned adjacent the lower tip of the respective tie cover region. The lower portions of the sides of each tie cover region converge together to form the lower tip of the respective tie cover region. Ideally, the upper portion of each side of each tie cover region is extended at an obtuse angle to the adjacent associated lower portion of the respective side of the respective tie cover region. In this ideal embodiment, the lower portions of the sides of each tie cover region are preferably extended at an obtuse angle to one another.

In use, each of the tie covers formed by the tie cover regions is designed for covering a surface of a tie 42 of a user such that the first face of the respective tie cover is positioned adjacent the surface of the tie of the user and the upper end of the tie cover is positioned adjacent the knot of the tie of the user and the lower tip of the tie cover is positioned adjacent the lower end of the tie of the user.

Each of the tie cover regions preferably has a plurality of spaced attachment patches 43,44,45 coupled thereto on the first face of the sheet. A first of the attachment patches 43 of each tie cover region is positioned adjacent the upper end of the respective tie cover region. A second of the attachment patches 44 of each tie cover region is positioned adjacent the tip of the respective tie cover region. A third of the attachment patches 45 of each tie cover region is generally equidistantly positioned between the first and second patches of the respective tie cover region. In use, the attachment patches each are designed for detachable attachment to a surface of a tie of a user. The attachment patches each may have hook portions of a hook and loop fastener provided thereon for detachable attachment to a fabric material tie of a user to attach the tie cover to the tie of the user. Optionally, the attachment patches may each have an adhesive thereon for detachable attachment to a tie of a user to attach the tie cover to the tie of the user. As another option, the attachment patches may each have a clip coupled thereto for detachable attachment to a tie of a user to attach the tie cover to the tie of the user.

Each of the tie cover regions has a length defined between the upper end and lower tip of the respective tie cover region and a width defined between the sides of the respective tie cover region. Ideally, the length of each tie cover region is between 21 inches and about 23 inches. In this ideal embodiment, the maximum width of each of the tie cover regions is between about 2 inches and about 4 inches.

With reference to FIG. 1, the sheet is preferably stored in a box 46 having spaced apart generally rectangular upper and lower walls, and four generally rectangular side walls extending between the upper and lower walls of the box. The upper wall of the box has a generally rectangular elongate slot 47 therethrough. One of the end edges of the sheet is outwardly extended of the box through the slot of the upper wall of the box.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparel stain protector, comprising:

a scarf cover having first and second faces, a pair of end edges, and a pair of side edges extending between said end edges of said scarf cover;

said scarf cover having a length defined between said end edges of said scarf cover and a width defined between said side edges of said scarf cover;

said faces of said scarf cover each having a plurality of patches coupled thereto;

said patches of said scarf cover each having hook portions of a hook and loop fastener provided thereon, said hooks portions being adapted for detachable attachment to a fabric material garment of a user to attach said scarf cover to the garment of the user.

2. The apparel stain protector of claim 1, wherein said side edges of said scarf cover each have a first and second end regions and a middle region interposed between said end regions of the respective side edge of said scarf cover, said first end regions of said side edges of said scarf cover being positioned adjacent a first of said end edges of said scarf cover, said first end regions of said side edges of said scarf cover converging towards each other in a direction towards said first end edge of said scarf cover, said second end regions of said side edges of said scarf cover being positioned adjacent a second of said end edges of said scarf cover, said second end regions of said side edges of said scarf cover converging towards each other in a direction towards said second end edge of said scarf cover.

3. The apparel stain protector of claim 2, wherein said first end regions of said side edges of said scarf cover has about equal lengths to one another, and said second end regions of said side edges of said scarf cover has about equal lengths to one another.

4. The apparel stain protector of claim 2, said middle regions of said side edges of said scarf cover arc extended substantially parallel to one another, said middle regions of said side edges of said scarf cover having about equal lengths to one another.

5. The apparel stain protector of claim 1, wherein each of said faces of said scarf cover has a first of the respective patches positioned adjacent a first of said end edges of said scarf cover, and wherein each of said faces of said scarf cover has a second of the respective patches positioned adjacent a second of said end edges of said scarf cover.

6. The apparel stain protector of claim 5, wherein each of said faces of said scarf cover has a third of the respective patches positioned on the respective face of said scarf cover about equidistantly spaced between said end edges of said scarf cover.

7. The apparel stain protector of claim 6, wherein said patches of each face of said scarf cover each are about equidistantly positioned between said side edges of said scarf cover.

8. An apparel stain protector, comprising:

a generally rectangular sheet having first and second faces, a pair of end edges and a pair of side edges extending between said end edges of said sheet;

said sheet having a plurality of spaced apart and substantially parallel lateral separation lines extending between said side edges of said sheet, said lateral separation lines of said sheet dividing said sheet into a plurality of generally rectangular panels;

each of said panels having a pair of ends and a pair of sides defined along said side edges of said sheet;

each of said panels of said sheet having a tie cover region therein, said tie cover region of each of said panels having an outer boundary extending between the ends of the respective panel;

each tie cover region being separable from the associated panel along said outer boundary of the respective tie cover region;

each tie cover region forming a tie cover when separated from the associated panel adapted for covering a tie of a user;

said outer boundary of each tie cover region having an upper end, a lower tip and a pair of sides, each of said sides of each tie cover region having upper and lower portions;

said upper portions of each side of each tie cover region being positioned adjacent said upper end of the respective tie cover region;

said lower portions of each side of each tie cover region being positioned adjacent said lower tip of the respective tie cover region;

each of said tie cover regions having a plurality of spaced attachment patches coupled thereto on said first face of said sheet; and said attachment patches each being adapted for detachable attachment to a surface of a tie of a user.

9. The apparel stain protector of claim 8, wherein said sheet has a plurality of perforations along each of said lateral separation lines of said sheet for aiding separation of said sheet along said lateral separation lines of said sheet.

10. The apparel stain protector of claim 8, wherein each panel has a plurality of perforations along said outer boundary of the associated tie cover region.

11. The apparel stain protector of claim 8, wherein a first of said attachment patches of each tie cover region is positioned adjacent said upper end of the respective tie cover region, wherein a second of said attachment patches of each tie cover region is positioned adjacent said tip of the respective tie cover region, and wherein a third of said attachment patches of each tie cover region is generally equidistantly positioned between said first and second patches of the respective tie cover region.

12. The apparel stain protector of claim 11, wherein said attachment patches each having hook portions of a hook and loop fastener provided thereon.

13. An apparel stain protector system, comprising:

a scarf cover having first and second faces, a pair of end edges, and a pair of side edges extending between said end edges of said scarf cover;

said scarf cover having a length defined between said end edges of said scarf cover and a width defined between said side edges of said scarf cover;

said side edges of said scarf cover each having a first and second end regions and a middle region interposed between said end regions of the respective side edge of said scarf cover;

said first end regions of said side edges of said scarf cover being positioned adjacent a first of said end edges of said scarf cover, said first end regions of said side edges of said scarf cover having about equal lengths to one another;

said first end regions of said side edges of said scarf cover converging towards each other in a direction towards said first end edge of said scarf cover;

said second end regions of said side edges of said scarf cover being positioned adjacent a second of said end edges of said scarf cover, said second end regions of said side edges of said scarf cover having about equal lengths to one another;

said second end regions of said side edges of said scarf cover converging towards each other in a direction towards said second end edge of said scarf cover;

said middle regions of said side edges of said scarf cover being extended substantially parallel to one another, said middle regions of said side edges of said scarf cover having about equal lengths to one another;

said scarf cover comprising a flexible paper material, said scarf cover further comprising a fire-retardant composition applied to said flexible paper material of said scarf cover;

said faces of said scarf cover each having a plurality of generally rectangular patches coupled thereto;

said patches of said scarf cover each having hook portions of a hook and loop fastener provided thereon, said hooks portions being adapted for detachable attachment to a fabric material garment of a user to attach said scarf cover to the garment of the user;

each of said faces of said scarf cover having a first of the respective patches positioned adjacent a first of said end edges of said scarf cover;

each of said faces of said scarf cover having a second of the respective patches positioned adjacent a second of said end edges of said scarf cover;

each of said faces of said scarf cover having a third of the respective patches positioned on the respective face of said scarf cover about equidistantly spaced between said end edges of said scarf cover;

said patches of each face of said scarf cover each being about equidistantly positioned between said side edges of said scarf cover;

a generally rectangular sheet having first and second faces, a pair of end edges and a pair of side edges extending between said end edges of said sheet;

said end edges of said sheet being extended substantially parallel to one another, said side edges of said sheet being extended substantially parallel to one another and substantially perpendicular to said end edges of said sheet;

said sheet having a plurality of spaced apart and substantially parallel lateral separation lines extending between said side edges of said sheet, said lateral separation lines of said sheet dividing said sheet into a plurality of generally rectangular panels;

said lateral separation lines of said sheet being spaced apart at generally equal intervals between said end edges of said sheet;

said sheet being separable along each of said lateral separation lines of said sheet;

said sheet having a plurality of perforations along each of said lateral separation lines of said sheet for aiding separation of said sheet along said lateral separation lines of said sheet;

each of said panels having a pair of ends extending substantially parallel to said end edges of said sheet and a pair of sides defined along said side edges of said sheet;

each of said panels of said sheet having a tie cover region therein, said tie cover region of each of said panels having an outer boundary extending between the ends of the respective panel;

each tie cover region being substantially centered between said sides of the respective panel;

each tie cover region being separable along said outer boundary of the respective tie cover region;

each panel having a plurality of perforations along said outer boundary of the associated tie cover region;

each tie cover region forming a tie cover when separated from the associated panel;

said outer boundary of each tie cover region having an upper end, a lower tip and a pair of sides, each of said sides of each tie cover region having generally straight upper and lower portions;

said upper portions of each side of each tie cover region being positioned adjacent said upper end of the respective tie cover region;

said upper portions of said sides of each tie cover region converging towards one another towards said upper end of the respective tie cover region;

said lower portions of each side of each tie cover region being positioned adjacent said lower tip of the respective tie cover region;

said lower portions of said sides of each tie cover region converging together to form said lower tip of the respective tie cover region;

said upper portion of each side of each tie cover region being extended at an obtuse angle to the adjacent associated lower portion of the respective side of the respective tie cover region;

said lower portions of said sides of each tie cover region being extended at an obtuse angle to one another;

each of said ties formed by said tie cover regions being adapted for covering a surface of a tie of a user;

each of said tie cover regions having a plurality of spaced attachment patches coupled thereto on said first face of said sheet;

a first of said attachment patches of each tie cover region being positioned adjacent said upper end of the respective tie cover region;

a second of said attachment patches of each tie cover region being positioned adjacent said tip of the respective tie cover region;

a third of said attachment patches of each tie cover region being generally equidistantly positioned between said first and second patches of the respective tie cover region;

said attachment patches each having hook portions of a hook and loop fastener provided thereon;

a generally rectangular box having spaced apart generally rectangular upper and lower walls, and four generally rectangular side walls extending between said upper and lower walls of said box;

said sheet being disposed in said box; and said upper wall of said box having a generally rectangular elongate slot therethrough, one of said end edges of said sheet being outwardly extended of said box through said slot of said upper wall of said box.

* * * * *